United States Patent [19]

Sedlaczek

[11] Patent Number: 4,673,491

[45] Date of Patent: Jun. 16, 1987

[54] PROCESS AND APPARATUS FOR THE CENTRIFUGAL SEPARATION OF FINE-GRAIN MINERAL MIXTURES

[75] Inventor: Walter Sedlaczek, Elizabeth Bay, Australia

[73] Assignee: Miset AG, Hünenberg, Switzerland

[21] Appl. No.: 726,400

[22] Filed: Apr. 23, 1985

[30] Foreign Application Priority Data

May 2, 1984 [CH] Switzerland ..... 2129/84

[51] Int. Cl.[4] ..... B03B 5/58; B04B 5/02; B04B 5/10

[52] U.S. Cl. ..... 209/453; 209/423; 209/452; 209/466; 209/471; 209/477; 209/479; 209/486; 209/493; 209/498; 209/500; 209/502; 209/504; 494/33; 494/53; 494/74; 210/512.3; 210/325; 210/787

[58] Field of Search ..... 209/423, 424, 445, 451, 209/452, 453, 466, 467, 468, 469, 471, 472, 473, 479, 480, 482, 477; 210/512.3, 325, 787, 370; 494/33, 53, 66, 67, 74, 75; 55/203, 400, 406

[56] References Cited

U.S. PATENT DOCUMENTS

| | | | |
|---|---|---|---|
| 689,572 | 12/1901 | Berrigan | 494/33 X |
| 935,311 | 9/1909 | Laist | 494/33 X |
| 1,861,878 | 6/1932 | Quiroz | 494/33 |
| 2,368,876 | 2/1945 | Terradas | 210/325 X |
| 2,822,127 | 2/1958 | Sinn | 494/33 |
| 4,199,459 | 4/1980 | Filipowicz et al. | 494/33 X |
| 4,454,041 | 6/1984 | Kelsey | 494/33 X |
| 4,481,020 | 11/1984 | Lee et al. | 55/203 |

FOREIGN PATENT DOCUMENTS 1133321 10/1963 Fed. Rep. of Germany .

*Primary Examiner*—S. Leon Bashore
*Assistant Examiner*—Thomas M. Lithgow
*Attorney, Agent, or Firm*—Watson, Cole, Grindle & Watson

[57] ABSTRACT

Separating elements (14) arranged about a central shaft (1*a*) rotate in common about the main axis (A) and individually about their longitudinal axes (B). A centrifugal distributor (6) distributes fine-grain mineral mixture mixed with fluid uniformly to the separating elements (14). In each separating element (14) the partial material flow (2*a*) is set in rotation about the longitudinal axis (B) by entrainment vanes (18) arranged in a first separating element section (15*a*) and the heavy fraction is centrifuged on to the separator wall (16*a*). In the second section (15*b*), formed as conical tubular worm conveyor, which contains no entrainment vanes, the heavy fraction is transported to the collecting chamber (21) and discharged through first discharge openings (22), the fine-grain mineral mixture being fluidized in pulsation on the separating wall (16*b*) by the combined rotating movements and the heavy fraction being concentrated. From an annular chamber (26) fluid can be injected into the second section (15*b*) and the heavy fraction can thus be still further purified. A displacement body (24) guides the light fraction and fluid to second discharge openings (23). The separator apparatus is axially movably mounted and is set in axially oscillations by means of a wobble plate (31).

Due to the collaboration of the movements a continuous separation of fine-grain mineral mixture is guaranteed without blockage of the apparatus.

17 Claims, 5 Drawing Figures

PROCESS AND APPARATUS FOR THE CENTRIFUGAL SEPARATION OF FINE-GRAIN MINERAL MIXTURES

BACKGROUND OF THE INVENTION

1. Field of the Invention

The invention relates to a process for winnowing a heavy and a light fraction form a fine-grain mineral mixture under the action of centrifugal force, in which the fine-grain mineral mixture, mixed with a fluid, is charged as a fluidized current of material in the direction of a main axis, as well as to apparatus for carrying out the process.

2. The Prior Art

A continuously working centrifuge for the separation of solid-liquid mixtures is already known (see U.S. Pat. No. 2,822,127) in which several sieve drums are arranged on the arms of a rotor and are rotatable in a planetary manner about the vertical axis of rotation of the rotor. Each sieve drum is at the same time additionally capable of being set in rotation about its own axis, parallel to the axis of rotation of the rotor. The centrifuge further comprises a distributor device for feeding the mixture to the sieve drums, a material discharge device and a drive device for the rotor and the sieve drums. In this centrifuge, due to the relative rotation of the rotor arms and the sieve drums, there results a cyclic variation of the centrifugal force acting upon the treated material in the sieve drum, so that in each case nearest to the rotor rotation axis a short-term lifting of the material away from the sieve drum wall takes place in the region of the sieve drum wall. This pulsation has the effect that the material is moved by the force of gravity along the sieve drum wall to the outlet. However, with such a centrifuge, in which the solids freed from the liquid emerge at the lower end of the sieve drums, a separation of fine-grain mineral mixtures into fractions is not possible.

Furthermore, a similar centrifuge is known (see U.S. Pat. No. 4,199,459) which likewise is intended for the continuous separation of solid-liquid mixtures and which comprises oppositely rotating filter drums with perforated or closed shells arranged in a planetary manner in a vertical rotor, in which drums the material to be centrifuged does not however move over the drum shell, but rather the solids are conducted away by means of worms or channels penetrating the sieve drums. This centrifuge is not suitable either for the separation of fluidised fine-grain mineral mixtures, because it merely only permits a separation of liquid, while the solids are discharged together.

Finaly, an apparatus for obtaining a light fraction and a heavy fraction from a fine-grain mineral mixture is also known see No. DE-C-1133321 in which a slurry containing the mixture is fed axially to a cylindrical vessel. In the cylindrical wall the vessel comprises at least one helical discharge channel for the heavy fraction and contains a propeller with which the charged slurry is set into swirl or rotation. The discharge of the heavy fraction takes place in the upper part of the vessel which is set into rotational and longitudinal oscillations, while the light fraction is drawn off by means of an immersion syphon or the like. Such an apparatus is solely suitable for the preparation of very fine-grained material, is of relatively complicated and thus costly mode of construction, is prone to interruptions of operation and can achieve only small throughputs per machine unit.

It was therefore the problem of the present invention to produce a process and a cost-favourable apparatus for the separation, especially the continuous separation, of a fine-grain mineral mixture into a heavy fraction and a light fraction, guaranteeing a qualitatively satisfactory, reliable and trouble-free separation of any desired fine-grain mineral mixtures, free of any restrictive conditions as regards the composition by weight, and with a higher throughput.

SUMMARY OF THE INVENTION

The solution in accordance with the invention to the problem consists in a process for winnowing a heavy and a light fraction from a fine-grain mineral mixture under the action of centrifugal force, wherein the fine grain mineral mixture mixed with a fluid is charged as a flow of material in the direction of a main axis, comprising the steps of dividing the continuously charged material flow into several quantity-regulated partial material flows with equal volume and equal proportion of fine-grain mineral mixture and each partial material flow is conducted through a separation region extending at a distance parallel to the main axis and surrounded by a rotationally symmetrical inner circumferential surface of a tube-type separation element, the separation elements rotating both together about the main axis and individually each about its own longitudinal axis; and of bringing each partial material flow in a first section of its separation region into rotation about the longitudinal axis with approximately the same angular speed as the separating element in order to centrifuge the fine-grain mineral mixture to the inner circumferential surface, whereby the fine-grain mineral mixture is fluidised and the heavy fraction, separated from the light fraction, collects on the circumferential surface due to the combined effect of the rotating movements of the separating element about the main axis and about the longitudinal axis, while in an adjoining second section of the separation region the rotating movement of the partial material flow is reduced and the collected heavy fraction is moved on the circumferential surface towards and discharged through lateral discharge openings while the light fraction and fluid are discharged at the end of the separating region.

A further object of the invention is an apparatus for carrying out the process, in which apparatus several tube-type separating elements are arranged in uniform distribution around the central shaft axis, hereinafter called main axis, for rotation about their longitudinal axes parallel to the main axis in retaining fittings secured to a central shaft and a centrifugal distributor with coaxial impeller, coaxial inlet and peripheral outlets is integrated in the central shaft, each of the outlets being connected to one of the separating elements through a pipe elbow and a seal for rotary movement and the centrifugal distributor being arranged to distribute a mixture of fluid and fine-grain mineral uniformly charged in the form of a flow of material through the inlet in quantity-regulated partial material flows to the separating elements; in that one or more drive devices are present to which the central shaft and the separating elements are connected or couplable in order to cause the central shaft with the centrifugal distributor and the separating elements to rotate about the main axis and at the same time to cause the separating elements to rotate about their longitudinal axes; and in that each tubular separating element has an integral circumferential surface which is rotationally symmetrical in relation to the longitudinal axis, contains drive means for the partial material flow at the inlet end in a first section in order to set this flow in rotation about the longitudinal axis in the first section with approximately the same angular speed as the separating element, and comprises an adjoining pot-like second section which is closed off by a bottom, each separating element comprising above the bottom a heavy material collecting chamber extending around on the inner circumferential surface and open towards the first section, with a plurality of first discharge openings leading to the exterior for the reception and discharge of the heavy fraction deposited on the inner circumferential surface and moved along this surface to the collecting chamber, and contains at the bottom second discharge openings leading laterally outwards for the discharge of the light fraction and of fluid from the central chamber region around the longitudinal axis.

The invention will be explained below in greater detail by means of an exemplary embodiment with reference to the accompanying drawings.

DETAILED DESCRIPTION OF THE PREFERRED EMBODIMENT

Figures 1, 2, 3, 4:
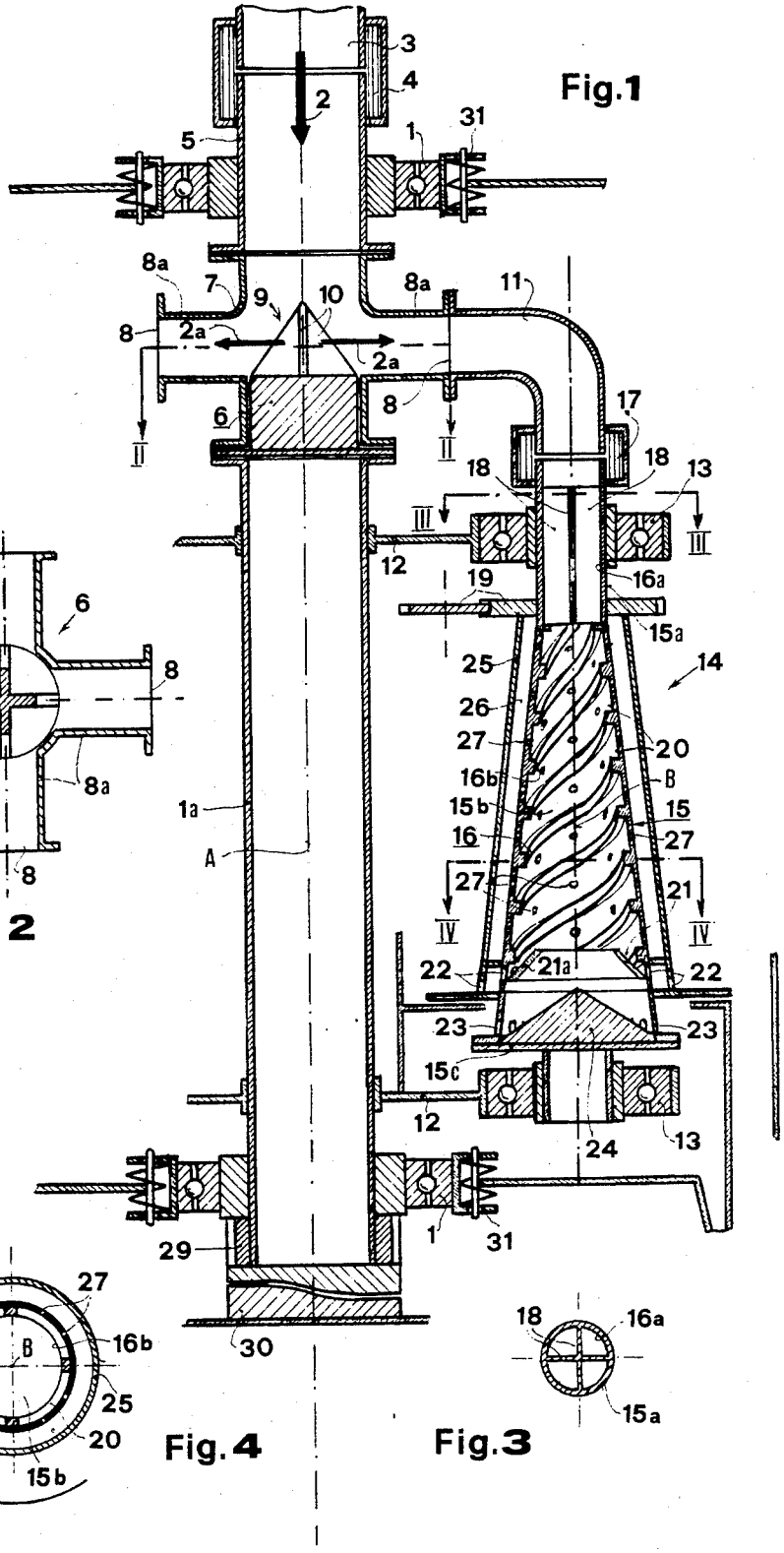
FIG. 1 is a longitudinal section through a separating apparatus according to the invention, in which only one of the several similar separating elements is represented.
FIG. 2 is a cross-section through the apparatus in the region of the division of the charged material stream, along the line II—II in FIG. 1.
FIG. 3 is a cross-section through a separting element in the region of its first section along the line III—III in FIG. 1.
FIG. 4 is a cross-section through the separting element in the region of its second section along the line IV—IV in FIG. 1.

In a housing of the separating apparatus, not illustrated further in the drawing, a central shaft 1*a* is rotatably mounted, for example, in ball bearings 1. The feed of the fluidized material stream reproduced symbolically by an arrow 2 in FIG. 1 takes place through a pipe 3 coaxial with the central shaft 1*a* so that the stream of material is fed in the direction of the main axis A of the separating apparatus defined by the central shaft 1*a*. The fine-grain material mixture to be separated into weight fractions, is mixed as usual in a reservoir with liquid, especially water, or gas, especially air, for which purpose the reservoir contains an agitator mechanism or is equipped with a blower, as the case may be. Devices for such a treatment of material for separation are very well known so that they do not need to be described in greater detail and are also not illustrated in the drawing.

The apparatus will firstly be described below with reference to the example of wet material, that is material mixed with liquid, for separation.

At the charging end of the central shaft 1*a* the material stream or current 2 is divided into several component material currents 2*a*, four in the illustrated embodiment. For the division of the material current 2 the central shaft 1*a* carries at the charging end a centrifugal pump 6 as centrifugal distributor, the housing 7 of which is flanged, for example, to the central shaft 1*a*, and four laterally projecting distributor arms 8*a* in the form of pipe branches provided with flanges, as outlets 8. A pipe piece 5, to which the pipe conduit 3 is connected through a seal 4 such as is used for the sealing of rotating shafts, is flanged to the inlet of the centrifugal pump 6.

Four elongated separating elements 14 are arranged in uniform distribution around the central shaft 1*a*, with their longitudinal axis B parallel to the main axis A. Each separating element 14 is mounted rotatably about its longitudinal axis B, for example in ball bearings 13, which are inserted in carrier arms or carrier discs 12 secured to the central shaft 1*a*. Only one of the separating elements 14, which are like one another in configuration, is represented in FIG. 1. Each separating element 14 has a substantially tubular hollow body 15, the inner circumferential surface 16 of which forms the separating element wall. A pipe elbow 11 is flanged to each distributor arm 8 of the pump housing 7 and is connected at its outlet end with one of the separating elements 14 by way of a seal 17 which is made the same as or similar to the seal 4.

Figure 5:
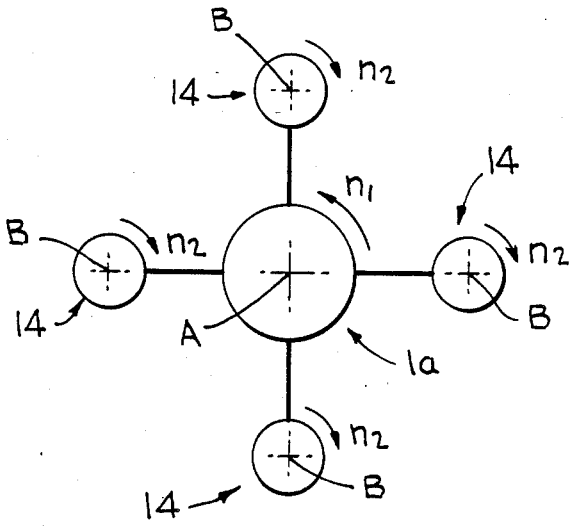
FIG. 5 shows a schematic top view of the separating apparatus showing the relative rotations of the central shaft and the four separating elements.

In operation, the central shaft 1*a* with the separating elements 14 arranged on its carrier arms or carrier discs 12 rotates about the main axis A and at the same time and independently thereof the separating elements 14 rotate about their longitudinal axes B. The drive device (now shown in the drawing) necessary for this purpose can be of any desired construction, but is preferably arranged so that the directions and rates of revolution for the central shaft 1*a* and for the separating elements 14 are selectable (see FIG. 5). In FIG. 1 the rotating drive of the central shaft 1*a* is represented diagrammatically by a drive member 29 and the rotating drive of the separating element 14 by a pair 19 of toothed gearwheels.

The separating elements 14, which will be described in detail further below, are very sensitive to variations of throughput. Variations in the volume and/or in the fine-grain mineral mixture proportion of the partial material current charged into the separating element would necessarily and automatically also result in a variation of the separating output of the separating element. Therefore uniformity of the charged material is an essential prerequisite for a high separation output.

According to a first feature of the process according to the invention, therefore, the continuously charged current of material is divided into several quantity-regulated partial material curents, here four, with equal volumes and equal proportions of fine-grain mineral mixture. For this purpose the separator apparatus contains the centrifugal pump 6, mentioned already above as the centrifugal distributor, which is fed with a fine-grain mineral mixture from a supply reservoir and from which all the separating elements 14 are uniformly charged. Since now the separating performance of each separating element 14 is coupled with the quantity regulation of the fine-grain mineral mixture charged into it, in order to achieve a high separation performance in each case a correct and matched quantity metering by the centrifugal pump is necessary. Hence, here the matching of the metered quantity is achievable by a simple change of the impeller with the vanes or blades of the centrifugal pump to the specification of the material current, for example the slurry, in each case, and also the r.p.m. of the centrifugal pump can be optimized for the fine-grain mineral mixture supplied in each case. As shown in FIGS. 1 and 2, the impeller 9 of the centrifugal pump 6 comprises as many blades or vanes 10 as there are separating elements 14, and the vanes 10 are aligned with the distributor arms 8*a* of the pump housing 7 (FIG. 2). The impeller 9, or in the illustrated embodiment the pump cross-piece with the vanes or blades 10, is designed as an exchangeable constructional unit which is securable on the end of the centrifugal shaft 1*a*.

For the continuous separation of the fine-grain mineral mixture into a heavy fraction and a light fraction, each quantity-regulated partial material current 2*a*, for example a slurry current consisting of a liquid and a proportion of fine-grain mineral mixture differing in dependence upon the material, is introduced in a nearly laminar flow into the separating element 14 allocated to it, the tube-like hollow body 15 of the rotationally symmetrical separating element 14 with the separating wall 16 peripherally enclosing the partial material current and forming the separation region for the latter.

In accordance with the invention the partial material current swirls in a first section of the separation zone with the same angular speed as the separating wall about its longitudinal axis B. For this purpose the tubular hollow body 15 of the separating element 14 comprises a first cylindrical section 15*a* in which, as shown in FIG. 3, preferably drive or entraining vanes 18 are arranged. The separating element 14 rotates about its own longitudinal axis B, such that the partial material current of fine-grain mineral mixture in the first section 15*a* is centrifuged to the separating wall section 16*a*. At the same time, because the separating element 14 as a whole rotates about the main axis A, the partial material current is also rotated about this main axis A. The rate of revolution $n_1$ of the separating elements 14 about axis A (see FIG. 5) is different from the rate of complementary revolution $n_2$ of the separating elements 14 about their own axis B. This combined rotating movement leads to a cyclic variation of the centrifugal force acting on the fine-grain mineral mixture on the separating wall, whereby, as is known, a fluidization or pulsation of the fine-grain mineral mixture is effected and the separation work known from the conventional settling table is performed. While, however, in the case of the settling table for given masses the magnitude of the separting force, or the amount of the separating vector, is given at most by gravity acceleration g, in the case of the rotating separating elements it is determined by the centrifugal acceleration or by the rate of revolution so that it is easily possible to achieve values of 60 g for the centrifugal acceleration in an economical manner. In the case of the separating element the separation of the fine mineral mixture into a heavy fraction, which collects directly on the separating wall, and a light fraction lying thereon, takes place correspondingly more quickly and more precisely. The fluid, that is the liquid or the gas, is then situated in the centre of the plug thus formed.

From the first separation zone section, in which the partial material current is rotating at the same rate of revolution as the separating wall 16, under compulsion of the drive vanes 18 engaging in it, the partial material current comprising the now already pre-sorted fine-grian mineral mixture passes into the second section, in which in accordance with the invention the rotation of the material current is retarded and conducted in a helical path along the separating wall 16*b* of this second section of the discharge. For the partial material current the decreasing rotation is achieved in a simple manner in that in the second section of the separating element 14 the entraining vanes 18 are omitted. Thus as soon as the partial material current emerges from the zone of the entraining vanes 18 its rotation will decrease relatively quickly for lack of supply of energy, so that the separating wall 16*b* is rotating faster than the still rotating partial material current and thus carries out a relative rotating movement in relation to the latter. This relative rotating movement is utilized to convey the material resting on the separating wall 16*b* along the helical path to the discharge. For this purpose in the second section of the separating element 14 preferably several screw-thread-like channels or grooves 20 are provided in the separating wall 16*b*, the direction of the pitch of which channels or grooves being so selected that when the separating element 14 is rotating in the intended direction about its longitunal axis B, the outer layer of the partial material current is screwed towards the discharge. So that in the case of high internal friction of the fine-grain mineral mixture the feed motion towards the discharge does not cease due to the frictional resistance in the screw threading-type channels or grooves 20, the heavy fraction abutting on the separating wall 16*b* in the channels or grooves 20 is subjected to an addtional force component acting in the direction towards the discharge. This additional force component for the material transport is preferably generated in a simple manner in that the second section of the separation zone is widened continuously towards the discharge, that is, the second section of the separating element 14 has a conical form with a diameter that increases towards the discharge. The centrifugal acceleration increasing along the transport path when the separating element 14 is rotating then supplies this additional force component, and does so moreover independently of the nature of the fine mineral mixture and independently of the position of the separating elements 14 in space; in this way, at higher r.p.m.s provided per se, the apparatus can also be operated with the central shaft 1*a* arranged horizontally. While accordingly the separation of the fine-grain mineral mixture takes place in the first section 15*a*, the transport of the separated heavy fraction towards the discharge takes place in the second section 15*b*, while the second section 15*b* is formed as a preferably conical tubular worm conveyor.

Due to the formation of the second section 15*b* in the form of a tubular worm conveyor an enhanced separation of the fine-grain mineral mixture is also achieved. Since the fluidisation and pulsation of the fine-gain mineral mixture caused by the combination of the rotating movements about the main axis A and about the longitudinal axis B continue to act even in the second section 15*b* of the separating element 14 and above all on the separating wall 16*b*, a further enrichment or concentration of the heavy fraction occurs in the helical turns, that is in the channels or grooves 20, which necessitate for the heavy fraction affected by them a substantially longer discharge time than for the inner layer lying thereon and consisting mainly of light material.

The thus further concentrated heavy material fraction passes into a collecting chamber 21 provided in the second separating element section 15*b* somewhat above the bottom 15*c* thereof, which chamber is formed by a surrounding wall 21*a* protruding inwards from the separating wall 16*b*, and is discharged from this chamber through preferably adjustable first discharge openings 22 which are distributed along the collecting chamber 21 and conducted away as usual. The light fraction lying in the second section 15*b* of the separating element 14 closer to the longitudinal axis B and the major part of the fluid, for example liquid, situated in the centre are discharged radially through preferably likewise adjustable second discharge openings 23 arranged on the circumference of the hollow body 15 on the bottom 15*c*. To facilitate the discharge of the light fraction a conical displacement body 24 coaxial with the longitudinal axis B is situated on the bottom 15*c*. The discharged light fraction is collected in vessels and conducted away as usual.

In a further advantageous embodiment of the apparatus according to the invention each tube-type separating element 14 is surrounded in the region of the second section 15*b* by an outer shell 25 which defines an annular chamber 26 around the second section 15*b*. The annular chamber 26 is in communication through a plurality of for example radial nozzle bores 27 (FIG. 4) with the internal chamber of the second hollow body section 15*b*. Through a conduit (not shown in the drawing) leading for example from a hollow central shaft 1*a* to the annular chamber, fluid, liquid or gas, is fed to the annular chamber 26 by being injected into the second section 15*b* through the nozzle bores 27. If the second section 15*b* is equipped with screw turns, the nozzle bores 27 are arranged on the bottom of the channels or grooves 20. When the separating element is in rotation the fluid injected under pressure through the nozzle bores 27 becomes effective only in the lift-off phase of fluidisation so that there the heavy fraction collected on the separating wall 16*b* is permeated substantially radially by the fluid and cleansed of any light particles still present in it, which are flushed or blown by the injected fluid inwards towards the longitudinal axis B, that is into the separated light fraction, and discharged with the latter. If air is used as injected fluid the outer shell 25 expediently has a longitudinal slot 28 in which, as shown in FIG. 4, the wall zone defining the one longitudinal side is placed obliquely outwards so that when the separating element is rotating in the direction of the arrow air is forced from the ambient atmosphere through the slot 28 into the annular space 26 and no additional feed conduits to the annular chamber are necessary.

This above-described additional injection of gas, especially air, into the second hollow body section 15*b* is advantageous especially in the case of a dry material current, that is to say in the case of a fine-grain mineral mixture mixed with gas, especially air, and is therefore always provided in the case of the separation of dry material. For the separation of such dry fine-grain mineral mixture the apparatus is otherwise formed just as described above for the separation of wet fine-grain mineral mixture mixed with a liquid, especially water, with the difference only that in place of a centrifugal pump a centrifugal blower is used as the centrifugal distributor 6.

Unforeseen variations in the solid content of the material current can under some circumstances lead to troubles in operation, such as blockages of conduit parts of the apparatus. In order to preclude such faults, in a further development of the invention especially the partial material currents rotating about the main axis A are additionally subjected to a vibration along their longitudinal axis B so that considered as a whole the partial material currents carry out a three-dimensional oscillation. This three-dimensional oscillation of the partial material currents also heavily influences the separating operation itself, so that a still higher concentration of the heavy fraction can be achieved thereby. For the application of such a three-dimensional oscillation the rotor of the apparatus, that is the central shaft 1*a* with the centrifugal distributor 6 and the separating elements 14, is mounted for displacement to and fro along the main axis A, in that for example the ball bearings 1 are mounted oscillatably in the housing and an additional drive device is provided for the oscillation of the central shaft 1*a*. In the case of a vertically arranged central shaft 1*a* for the execution of such oscillations for example the central shaft 1*a* with its ball bearings 1 can be mounted in oscillation bearings 31 arranged in the housing and comprising bearing bolts and leaf springs, and rest with its lower end face on an eccentric plate or wobble plate 30 which is fixedly arranged in the housing.

As mentioned, the drive devices for the central shaft 1*a* and the separating elements 14 are adjustable as regards direction and speed of rotation so that the separting elements 14 can rotate in the same direction as or in the opposite direction to the central shaft 1*a*. Since then both the rotation rate about the main axis A, which determines the quantity regulation of the partial material currents 2*a*, and the rotation rate of the separating elements 14 are adjustable in operation, an optimum separation method can be produced for every fine-grain mineral mixture.

What I claim is:

1. A process for winnowing a fine-grain mineral mixture into a heavy fraction and a light fraction using centrifugal force, said process comprising mixing the fine-grain mineral mixture with a fluid to form a fluid suspension of the fine-grain mineral mixture; continuously charging the fluid suspension coaxially in the direction of a central shaft which defines a main axis; dividing the continuously charged fluid suspension into several quantity-regulated partial material flows having equal volumes and equal proportions of fine-grain mineral mixture; conducting each partial material flow through a separation region which is located at a distance from said main axis and which is parallel thereto, each said separation region being defined by a rotationally symmetrical inner circumferential surface of a tube-type separating element, each tube-type separating element having a longitudinal rotation axis which is defined by said inner circumferential surface and is parallel to said main axis, each said separation region having a first section and a second section, each of the separating elements being rotatable about said main axis and individually about their longitudinal rotation axis; passing each partial material flow to the first section of the separation region of the associated separating element; rotating the partial material flow in the first section around said main axis and around the associated longitudinal rotation axis, said rotation about the longitudinal rotation axis occurring at approximately the same angular speed as the separating element rotates about its longitudinal rotation axis, in order to centrifically stratify the partial material flow, thus causing the heavy fraction of the fine-grain mineral mixture to accumulate radially outwardly on the inner surface and the light fraction to accumulate radially inwardly toward the longitudinal rotation axis, the stratification being due to the combined effect of the rotating movements of the separating element about the main axis and about its longitudinal rotation axis; then passing each stratified partial material flow into the adjoining second section of the separation region wherein the rotating movement of the stratified partial material flow is reduced; axially conveying the radially outward heavy fraction along the inner circumferential surface and axially conveying the light fraction and fluid towards the end of the separation region; splitting said stratified partial material flow; discharging the radially outward heavy fraction laterally outwardly through discharge openings in said inner circumferential surface; and discharging the radially inward light fraction and fluid from the end of separation region.

2. Process according to claim 1, wherein the step of conveying the heavy fraction in the second section of each separation region comprises conveying the heavy fraction in a helical path over the inner circumferential surface to the discharge openings.

3. Process according to claim 2, wherein the step of conveying the heavy fraction in the second section of the separation region comprises conveying the heavy fraction to the discharged openings over said inner circumferential surface, which widens conically from the first section to the end of the separation region.

4. Process according to claim 3, including injecting fluid into the second section of the separation region of each separating element from the exterior through a plurality of lateral nozzle openings in said inner circumferential surface.

5. Process according to claim 3, further comprising oscillating the rotating separating elements in the direction of their longitudinal rotation axes.

6. Process according to claim 5, including rotating the individual separating elements about their longitudinal rotation axes in either the same or the opposite direction with respect to the rotation of the separating elements about the main axis.

7. Process according to claim 6, including rotating the individual separating elements about their longitudinal rotation axes at one rate of revolution and rotating the separating elements about the main axis at another rate of revolution.

8. Apparatus for winnowing a fluid suspension of a fine-grain mineral mixture into a heavy fraction and a light fraction, said apparatus comprising a central shaft having opposite ends and defining a central main axis; several substantially tubular separating elements, each tubular separating element defining a longitudinal axis, an inlet end and outlet end, said tubular elements being arranged in uniform distribution around said central main axis and parallel to said central main axis; retaining fitting means secured to the central shaft for supportably engaging said tubular elements and for allowing said tubular elements to rotate about their own longitudinal axes; a centrifugal distributor means comprising a coaxial impeller secured to one end of said central shaft; inlet means coaxial to said shaft for feeding said mixture to said impeller; peripheral outlet means connecting said inlet means at said impeller to said inlet end of each of said tubular separating elements, said peripheral outlet means being integrated with the top of said central shaft, each said outlet means comprising a pipe elbow and a seal; means for rotatably coupling each said elbow to said inlet end of said elements, the centrifugal distributor means functioning to distribute said fluid suspension of fine-grain mineral mixture which is charged through the inlet means in quantity-regulated partial material flows to the separating elements via the plurality of peripheral outlet means; drive means for causing the central shaft with the centrifugal distributor and the separating elements to rotate about the main axis and at the same time for causing the separating elements to rotate about their longitudinal axes; each tubular separating element comprising a first section at the inlet end of the element and a second section, said first section comprising entraining means for setting said partial material flow in rotation about the longitudinal axis with approximately the same angular speed as the separating element rotates about said longitudinal axis, said second section having opposite ends, one of said opposite ends being joined with said first section, said second section comprising an integral circumferential surface means which is rotationally symmetrical in relation to the longitudinal axis and which extends to the second of said opposite ends of said second section, said second end comprising a closed bottom, said surface means comprising an outer surface and an inner surface, said inner surface communicating with said first section, said surface means defining first discharge openings near said bottom and second discharge openings between said first discharge openings and said bottom; annular splitting means inside said surface means for directing the heavy fraction, which has accumulated radially outwardly on the inner surface, through said first discharge openings and allowing the light fraction and fluid which has accumulated radially inwardly to pass to said second discharge openings.

9. Apparatus according to claim 8, wherein said entraining means comprises radial entrainment vanes which are arranged in the first section of each separating element to rotate the partial material flow.

10. Apparatus according to claim 9, wherein said inner surface comprises a conical circumferential inner surface widening from said one end towards the bottom.

11. Apparatus according to claim 10, wherein said inner surface of each separating element is formed as a tubular worm conveyor with at least one helical worm means attached to the inner surface leading from the first section to the first discharge openings.

12. Apparatus according to claim 11, wherein a displacement body means coaxial with the longitudinal axis is arranged in every separating element on the bottom of the second section for conducting the light fraction and fluid to the second discharge openings.

13. Apparatus according to claim 12, wherein the second section of each separating element is surrounded by an outer shell defining an external, fluid-feedable annular chamber between said shell and said outer surface, said surface means defining a plurality of nozzle bores entering at the inner circumferential surface, which bores are arranged between the worm means and above the first discharge openings.

14. Apparatus according to claim 13, wherein the outer shell has an axially extended longitudinal slot in order to feed air as fluid into the annular chamber and blow it through the nozzle bores into the second section when the separating element is in rotation.

15. Apparatus according to claim 14, wherein for a wet fine-grain mineral mixture with a liquid, especially water, as fluid, the centrifugal distributor consists of a centrifugal pump having an impeller which is inserted coaxially into and extends coaxially above the central shaft.

16. Apparatus according to claim 14, wherein for a dry fine-grain mineral mixture with a gas, especially air, as fluid, the centrifugal distributor consists of a centrifugal blower having an impeller which is inserted coaxially into and extends coaxially above the central shaft.

17. Apparatus according to claim 14, wherein the central shaft with the centrifugal distributor and the separating elements is arranged for displacement to and fro along this main axis (A) and is connected with drive means for the execution of oscillation-type reciprocating movements.

* * * * *